US006398404B1

(12) United States Patent
Karasawa

(10) Patent No.: US 6,398,404 B1
(45) Date of Patent: Jun. 4, 2002

(54) METHOD OF PRODUCING FINE PARTICLE DISPERSIONS

(75) Inventor: Yukihiko Karasawa, Ohmiya (JP)

(73) Assignee: Karasawa Fine Co., Ltd., Ohmiya (JP)

( * ) Notice: Subject to any disclaimer, the term of this patent is extended or adjusted under 35 U.S.C. 154(b) by 0 days.

(21) Appl. No.: 09/555,646

(22) PCT Filed: Oct. 1, 1999

(86) PCT No.: PCT/JP99/05407

§ 371 (c)(1),
(2), (4) Date: Jun. 2, 2000

(87) PCT Pub. No.: WO00/20108

PCT Pub. Date: Apr. 13, 2000

(30) Foreign Application Priority Data

Oct. 2, 1998 (JP) ..... 10-281839

(51) Int. Cl.[7] ..... B01F 3/12

(52) U.S. Cl. ..... 366/162.4; 366/164.1; 95/261

(58) Field of Search ..... 366/102, 162.4, 366/164.1, 164.2, 164.3, 164.4, 164.5, 164.6, 348; 210/787–789, 512.1; 95/261

(56) References Cited

U.S. PATENT DOCUMENTS

| | | | | |
|---|---|---|---|---|
| 3,738,534 | A | * | 6/1973 | Abbott |
| 4,960,509 | A | * | 10/1990 | McNeill |
| 5,011,293 | A | * | 4/1991 | Roop et al. |
| 5,303,871 | A | * | 4/1994 | Bateson et al. |
| 5,380,089 | A | * | 1/1995 | Karasawa |
| 5,413,765 | A | * | 5/1995 | Smith et al. |
| 5,510,019 | A | * | 4/1996 | Yabumoto |
| 5,967,964 | A | * | 10/1999 | Hattori et al. |
| 6,051,630 | A | * | 4/2000 | Serafin et al. |

* cited by examiner

*Primary Examiner*—Charles E. Cooley
*Assistant Examiner*—David Sorkin
(74) *Attorney, Agent, or Firm*—Armstrong, Westerman & Hattori, LLP

(57) ABSTRACT

A method of producing a fine particle dispersion characterized by having a dispersing step where, after fine particles have been sucked into a dispersing medium to prepare a suspension by a suction type stirring machine and bubbles have been removed from the suspension by a bubble removing means, the suspension is pressurized and introduced from the opposite directions so as to collide with each other, thereby dispersing the suspension.

5 Claims, 11 Drawing Sheets

METHOD OF PRODUCING FINE PARTICLE DISPERSIONS

TECHNICAL FIELD

The present invention relates to a method of producing an ultrafine particle predispersion. More particularly, the present invention relates to an ultrafine particle dispersion producing method capable of producing an ultrafine particle dispersion for polishing surfaces of semiconductor devices, magnetic recording media and so forth without using a dispersant and without mixing a contaminant or the like into the dispersion.

BACKGROUND ART

Fine particles are used in various fields. For example, fine particles used in burning in the field of electronic industry are required to improve in purity, density, etc. For example, fine particles of barium titanate, which is a material used for a ceramic capacitor and the like, indispensably need to increase in purity to a high level or improve in density in order to attain an improvement in performance of the capacitor by stabilization of the burned configuration thereof.

Meanwhile, methods of producing semiconductor devices or magnetic recording media include precisely polishing surfaces to obtain mirror-finished surfaces. In these precision polishing methods, a fine particle dispersion for polishing is used. In particular, semiconductor devices are now highly integrated and also increased in the number of layers constituting a multilayered structure. Semiconductor devices having a multilayered structure need to planarize the surface of an interlayer insulator film formed between a pair of adjacent layers. In the semiconductor manufacturing process, the interlayer insulator film is planarized by polishing. Meanwhile, metal wiring is formed by a vacuum deposition means. In this case, it is necessary to smooth the deposited wiring film by removing minute unevenness varying in size and density.

In the process of polishing an oxide film formed of silicon dioxide to obtain a flat surface, colloidal silica with potassium hydroxide added thereto is used. In polishing a metal wiring film, the metal is polished chemically and mechanically by using a slurry prepared by mixing together an abrasive and an oxidizing agent.

Fine particle dispersions used in the chemical/mechanical polishing method are produced by dispersing particles of silica, alumina, zirconia, titania, ceria, manganese oxide, iron oxide, etc. using any of medium type dispersers, e.g. a bead mill, a ball mill, and a sand mill, stirring type dispersers, e.g. a colloid mill, and an ultrasonic disperser.

Fine particle dispersions used for chemical/mechanical polishing contain fine particles having a primary particle size of from 10 to 100 nanometers. A fine particle powder is dispersed in an alkaline or acidic aqueous solution. At the same time as the powder is dispersed, an electrical double layer is formed near the surfaces of the fine particles by ions in the aqueous solution, and the $\zeta$-potential of the particles in the slurry reduces. Accordingly, the attractive forces between the particles increase, causing an agglomeration phenomenon to occur. Consequently, the particles reach a stable state in the form of agglomerates of the order of from 300 micrometers to 1 millimeter in size. In the present semiconductor manufacturing process, a particle size of 140 to 200 nanometers in terms of center particle size is demanded for fine particle dispersions used in chemical/mechanical polishing, and the breadth of the particle size distribution demanded is from 100 to 400 nanometers. Therefore, the agglomerates need to be redispersed by some method.

When only a stirring type disperser is used to redisperse the fine particles for polishing, most of the agglomerates cannot be redispersed even if the treatment is carried out for a considerably long period of time.

In the case of a fine particle dispersion for chemical/mechanical polishing that uses silica particles as an abrasive, an alkaline solution prepared by dissolving potassium hydroxide in ultrapure water is mixed with 13% to 25% by weight of silica having a primary particle size of from 20 to 30 nanometers to obtain a dispersion. The obtained dispersion is stirred at high speed for 1 hour at 3,000 rpm and further subjected to dispersing treatment for 1 hour at 1,400 rpm in a bead mill using beads having a diameter of 2 millimeters, thereby obtaining a fine particle dispersion for polishing that has a center particle size of 230 nanometers and a viscosity of 6 to 10 mPa·s.

In the case of using a medium type disperser, e.g. a ball mill, a fine particle dispersion having a center particle size of the order of 200 nanometers and a particle size distribution breadth of from 150 to 700 nanometers is obtained. Thus, it is difficult to obtain a sharp particle size distribution. In addition, as the period of time of treatment becomes longer, the medium itself is worn by a larger amount, causing the fine particle dispersion to be contaminated. This may lead to contamination of semiconductor devices.

Fine particle dispersions obtained by the above-described dispersing method differ in treating characteristics for each batch of agent owing to the change with time. Consequently, it is impossible to provide consistency in polishing results. Moreover, there is a problem that the slurry settles in a tank for supplying an amount of abrasive slurry sufficient to polish a number of wafers for one day, which is known as a "day tank"; therefore, it is essential to discharge the slurry from the tank to the outside and dispose of it.

High-purity fine particles are also demanded in the fields of paper, cosmetics, paint, food and so forth. In the field of paper industry, for example, it is demanded that fine particles used as an inner filling material and surface modifying material should be purified to a higher level. In addition, the use of a highly concentrated fine particle dispersion is demanded in order to obtain high paper quality.

In fine particle dispersions used as food additives, it is also demanded to improve absorptivity by atomization and to obtain contamination-free fine particles.

However, it is extremely difficult to obtain a fine particle dispersion in which fine particles are stable in a suspension state. Accordingly, a method of obtaining a high-purity fine particle dispersion within a short period of time without using particles or the like for dispersion has been demanded.

When a fine particle dispersion of a single composition or a plurality of compositions is suspended in a suspending medium suitable therefor, fine particles often float on the surface of the suspending medium without sinking into it in the case of an ordinary introducing and stirring method because fine particles have a large surface area and hence an extremely small bulk specific gravity in comparison to the true specific gravity.

When a fine particle dispersion of a single composition or a plurality of compositions is suspended in either a suspending medium unsuitable therefor, or when a fine particle dispersion of a plurality of compositions of different nature is suspended in either of the suspending mediums, even if the fine particles are introduced into the suspending medium, a considerably long time is required to obtain a uniform predispersion in the case of preliminary stirring by a stirring machine or the like. Consequently, the fine particles undesirably agglomerate before it is sufficiently stirred in the suspending medium. Thus, it is difficult to obtain a uniform predispersion.

Under these circumstances, Japanese Patent Application Unexamined Publication (KOKAI) Nos. 10-310415 and 11-57521 disclose a method in which fine particles are predispersed in water while being sucked by a powder introducing and mixing disperser (trade name: Jet Stream Mixer). According to the method, fine particles are introduced directly into a dispersing medium and stirred at the same time to perform preliminary dispersion. In this method, blades for stirring are rotated at high speed to produce a negative pressure to introduce fine particles together with air. Such a system uses an apparatus in which a lubricating oil is used in the rotating shaft part to allow the stirring blades to stably rotate at high speed.

FIG. 12 is a diagram illustrating a conventional suction stirring apparatus.

A suction stirring apparatus 71 is installed in a suspension tank 72. A rotor 74 connected to a rotating shaft 73 is rotated at high speed by a motor 75. As a result, a negative pressure is formed in the vicinity of the rotor in a suspending medium 76, causing fine particles 78 in a fine particle storage tank 77 to be sucked through a suction flow path 79, which is formed around the rotating shaft 73, and injected into the suspending medium 76 in the suspension tank 72. In addition, a cylindrical stator 80 is formed around the rotor 74 to induce a circulating flow 81 circulating through the inside and outside of the cylindrical stator 80. Thus, mixed dispersing is performed by the circulating flow 81 and the shearing force of the rotor 74.

In order to ensure the suction flow path 79 to suck fine particles together with air, the apparatus needs to prevent air from flowing thereinto through any portion except a duct 82 for introducing fine particles. Accordingly, the upper portion of the rotating shaft has a hermetically sealed structure. A hermetic structure using a mechanical seal is used for a bearing portion 83 that rotates at high speed, i.e. from 3,000 to 4,000 RPM.

As a mechanical seal used in such a bearing portion, it is essential to use an oil-filled seal because the bearing portion is a part that rotates at high speed. An oil-filled mechanical seal cannot prevent the oil filled therein from penetrating along the rotating shaft by the action of a negative pressure produced in the pipe as the rotating shaft rotates. Therefore, it is difficult to completely prevent oil from adhering to fine particles when the particles pass through the suction flow path formed around the rotating shaft. Thus, the oil-filled mechanical seal suffers from the problem that a high-purity predispersion cannot be obtained.

Moreover, when fine particles are sucked, air is also introduced together with the fine particles. Consequently, air undesirably remains as fine bubbles in the suspension. Therefore, if it is intended to disperse the predispersion through collision under pressure without using particles for dispersion, the bubbles in the suspension undesirably act as a buffer, reducing the pressurizing efficiency, and thus making it difficult to disperse the predispersion satisfactorily.

If it is intended to disperse the predispersed suspension to a high degree by a dispersing apparatus using particles for dispersion, e.g. a bead mill, a ball mill, or a sand mill, an extremely long time is required. Consequently, contaminants are generated from the particles for dispersion, causing the purity to be reduced. Moreover, it is difficult to obtain a dispersion in which fine particles are uniformly dispersed.

Accordingly, methods of producing a dispersion without using particles for dispersion are proposed, for example, in Japanese Patent Application Unexamined Publication (KOKAI) Nos. 9-193004, 9-142827, 10-310415 and 11-57521. Dispersing methods employed in these methods use dispersing apparatus based on a high-pressure impact system, an opposed impact system, etc. The first system is arranged to obtain a fine particle dispersion by jetting out a predispersed fine particle suspension from a nozzle under high pressure so that the fine particle suspension collides against a plate having a high hardness (trade name, Manton-Gaulin Homogenizer: Doei Shoji). With this system, however, the plate member wears out at a high rate, and consequently, the problem of contamination cannot be solved. The second system is arranged to obtain a fine particle dispersion as follows. After a high pressure has been applied to a predispersed fine particle suspension, the flow path is branched, and after the fine particle suspension has been once made to collide against a plate member, the branched flow paths are changed in direction through 90 degrees so that fine particle dispersions collide with each other (trade name, Microfluidizer: Mizuho Kogyo; Nanomizer: Tsukishima Kikai; Genus PY: Hakusui Kagaku Kogyo, etc.). However, in the process of changing the flow path through 90 degrees by collision after branching the flow path under high pressure, impact caused by the collision against the plate member is large. Even when diamond is used, durability is very low. Moreover, the increase in throughput capacity is unfavorably limited by a structural problem.

According to a third system, after a high pressure has been applied to a predispersed fine particle suspension, the flow path is branched into two, and fine particle suspensions are made to collide with each other directly by nozzles opposed to each other, thereby obtaining a fine particle dispersion (trade name, Ultimizer: Karasawa Fine). The third system is superior to the first and second systems. However, it is practically impossible to oppose two nozzles to each other at a predetermined distance so that the nozzles are completely parallel to each other and the center lines of the nozzles are completely coincident with each other. Thus, there have been problems to be solved in terms of the generation of contaminants, mass productivity, durability, etc.

An object of the present invention is to provide a method of producing a high-purity fine particle dispersion without using a particulate substance for dispersion, the method being capable of producing contaminant-free high-purity fine particles within a reduced period of time. Another object of the present invention is to provide a method of producing a fine particle dispersion of favorable dispersion stability that will not thicken to gel or form a precipitate even if it is stored for a long period of time.

DISCLOSURE OF THE INVENTION

The present invention is a method of producing a fine particle dispersion characterized by having a dispersing step where, after fine particles have been sucked into a dispersing medium to prepare a suspension by a suction type stirring machine and bubbles have been removed from the suspension by a bubble removing means, the suspension is pressurized and introduced from opposite directions so as to collide with each other, thereby dispersing the suspension.

In the above-described method of producing a fine particle dispersion, the suction-stirring machine is arranged such that only a flow path for an air flow is formed in a space where a rotating shaft is exposed, and a flow path for fine particles is formed outside the flow path for an air flow.

In the above-described method of producing a fine particle dispersion, the bubble removing means is a cyclone type bubble removing means.

In the above-described method of producing a fine particle dispersion, a dispersing means capable of adjusting a center axis of a dispersing nozzle is used as one of two dispersing nozzles in the dispersing step.

In the above-described method of producing a fine particle dispersion, a dispersing means having a dispersing nozzle in which the cross-sectional area gradually increases from the inlet side thereof toward the outlet side thereof is used in the dispersing step.

BEST MODE FOR CARRYING OUT THE INVENTION

The method of producing a high-purity fine particles without using particles for dispersion according to the present invention can be carried out by using a mixing means capable of rapid mixing without introducing a contaminant into a liquid and further using a bubble removing means for removing bubbles introduced into the liquid during mixing and an opposed impact type dispersing means having excellent dispersibility.

Accordingly, the method of the present invention uses a suction stirring machine having a structure free from generation of a contaminant from the device body as a means for forming a hydrophobic or hydrophilic fine particle material of a single or plurality of compositions or a fine particle material of a plurality of compositions of both hydrophobic and hydrophilic natures, which is fit for the purpose, into an aqueous or nonaqueous suspension before it is highly dispersed. By using the suction stirring machine, the fine particle material is sucked and released into water or a nonaqueous solvent, and at the same time, stirring is carried out, thereby obtaining an extremely stable predispersion without using a dispersant regardless of the physical properties of the combination of particles and a liquid for suspension.

The obtained predispersion contains a large number of fine bubbles because of the suction of fine particles by the suction stirring machine. The bubbles constitute a serious obstacle to the pressurizing step. It was impossible to remove the bubbles completely even when the predispersion was allowed to stand for a considerably long period of time.

Accordingly, the highly dispersing method of the present invention is based on the finding that loss in the pressurizing step can be prevented by applying a high pressure to the suspension after fine bubbles have been removed by the debubbling means.

In addition, the highly dispersing method of the present invention is based on the finding that if the suspensions are made to collide with each other after the position of one of two opposed impact type nozzles has been precisely adjusted, the liquids surely collide with each other; therefore, no contaminant is generated from the equipment, and a high-purity highly dispersed fine particle dispersion can be obtained.

Furthermore, the present inventor found that it is possible to obtain a high-purity fine particle dispersion rapidly, safely and hygienically and to maintain the stability thereof for a long period of time by using, as the opposed impact type nozzles, nozzles capable of varying the size of particles to be produced under the same pressure conditions by changing the configuration of the nozzles according to the characteristics of the fluid or according to the necessary conditions.

The present invention will be described below with reference to the drawings.

Figure 1:
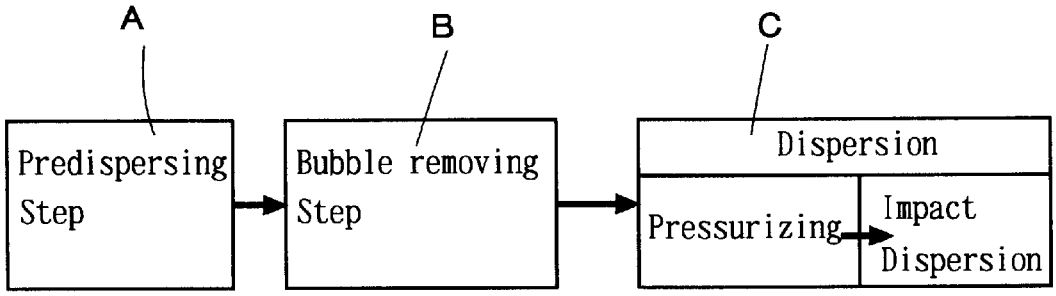
FIG. 1 is a diagram illustrating a method of producing a high-purity fine particle dispersion without using particles for dispersion according to the present invention.

FIG. 1 is a diagram illustrating the process of producing a high-purity fine particle dispersion without using particles for dispersion according to the present invention.

At a predispersing step A, a fine particle material of a single or plurality of compositions is continuously introduced into a suspending liquid, and at the same time, predispersion is carried out by shearing force. Next, the predispersed suspension is continuously debubbled at a bubble removing step B to remove fine bubbles.

Next, at a main dispersing step C, predispersed suspensions after the debubbling are made to collide with each other to effect dispersion, thereby obtaining a high-purity particle dispersion without using particles for dispersion.

Figure 2:
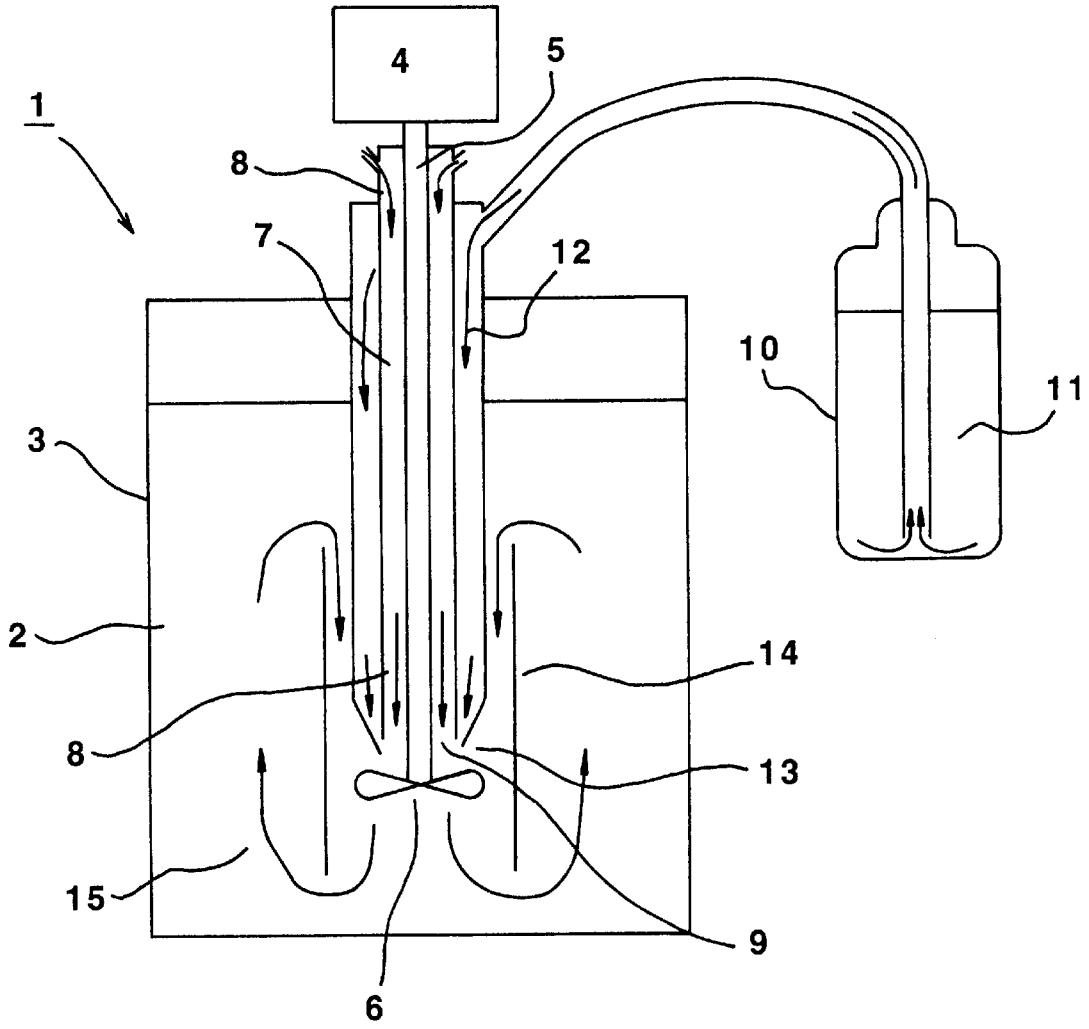
FIG. 2 is a diagram illustrating an example of a suction stirring apparatus usable in the predispersing step of the present invention.

FIG. 2 is a diagram illustrating an example of suction stirring apparatus usable in the predispersing step of the present invention.

A suction stirring apparatus 1 is installed in a suspension tank 3 containing a suspending medium 2. A rotor 6 is secured to a rotating shaft 5 connected to a motor 4. As the rotating shaft 5 rotates, a negative pressure is produced in the vicinity of the rotor 6. This induces an air flow 8 passing through an air flow passage 7 formed around the rotating shaft 5. Consequently, a negative pressure is produced in an air nozzle portion 9 at the distal end of the air flow passage 7. These negative pressures cause fine particles 11 in a fine particle storage tank 10 to be supplied through a fine particle passage 12, which is formed outside the air flow passage, and injected into the suspending medium 2 from a fine particle nozzle 13 at the distal end. Furthermore, a cylindrical stator 14 is provided to surround the above-described members. Therefore, a circulating flow 15 is formed inside and outside the stator. Dispersion is effected by large shearing force generated between the rotor and the stator. Shearing and swirling by a swirling flow induced inside and outside the stator are repeated to perform desired predispersion.

In the suction stirring apparatus, fine particles are sucked through a duct and stirred. Therefore, there is no likelihood that fine particles may scatter to contaminate the ambient atmosphere. However, because fine particles are conveyed by using an air flow, a large amount of air is present in the obtained predispersion in the form of fine bubbles. If the predispersion with fine bubbles suspended therein is used in the subsequent step, the fine bubbles may give rise to a problem. In addition, when the predispersion is pressurized to disperse it to a high degree by a method, for example, an opposed impact method, the fine bubbles undesirably act as a buffer because the compressibility of bubbles is higher than that of a liquid. Consequently, it becomes difficult to pressurize the predispersion satisfactorily.

Accordingly, the method of the present invention has the step of removing bubbles from the bubble-containing predispersion.

Figure 3:
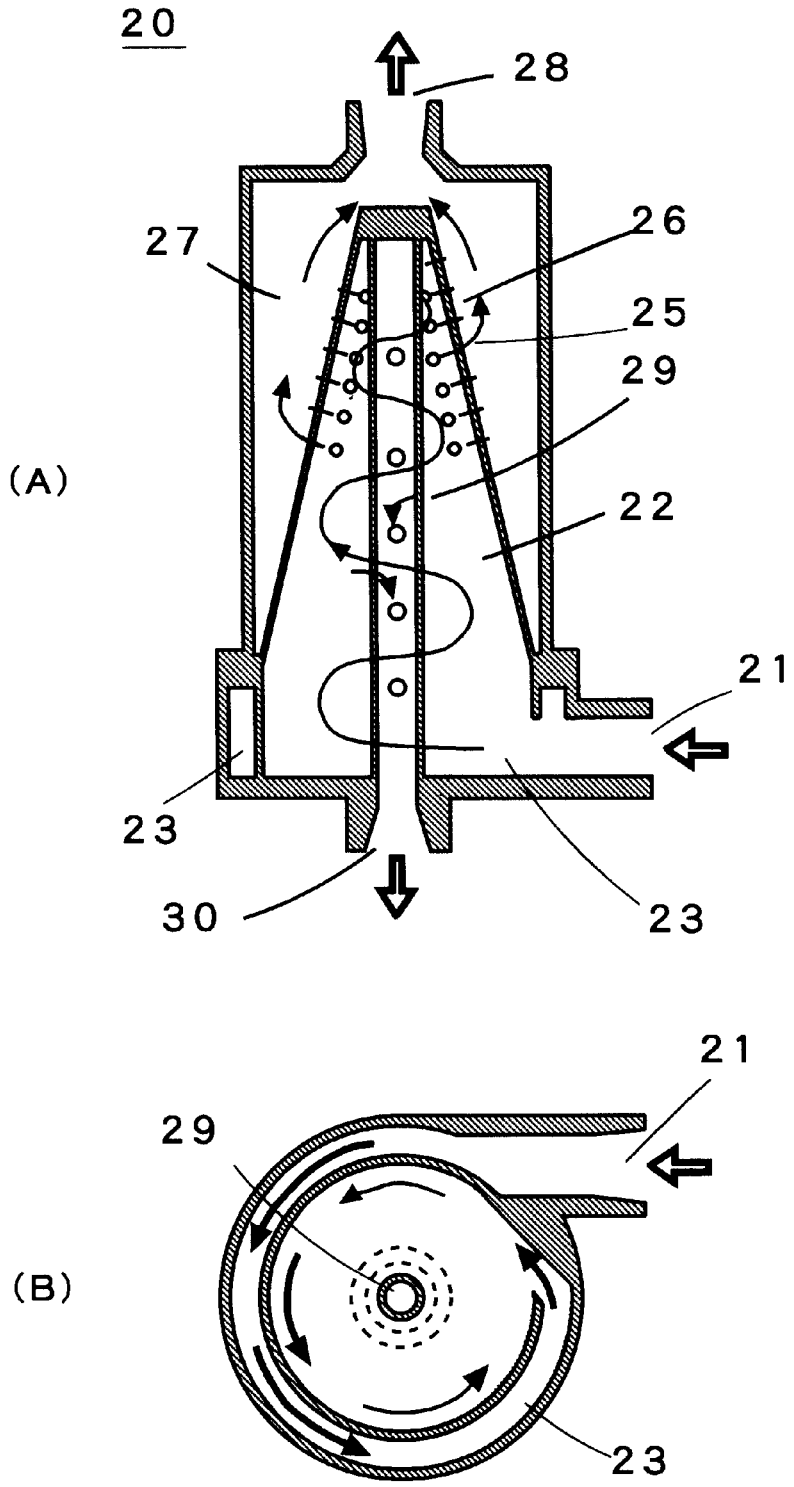
FIG. 3 is a diagram illustrating an example of a bubble removing apparatus used in the method of the present invention.

FIG. 3 is a diagram illustrating an example of bubble removing apparatus used in the method of the present invention. FIG. 2(A) shows a vertical sectional view, and FIG. 2(B) shows a horizontal sectional view.

A bubble removing apparatus 20 shown in FIG. 3 has an inlet 21 for a bubble-containing predispersion in the bottom thereof and a conical cyclone chamber 22 therein. A bubble-containing predispersion flowing in through the inlet 21 is changed into a swirling flow 24 in a preliminary swirling flow chamber 23. The bubble-containing predispersion flowing in continuously is accelerated as it is pushed upwardly in the cyclone chamber 22. By centrifugal force occurring at that time, the predispersion 25, which has a high density, is caused to move to an outer peripheral chamber 27 through a large number of fine holes 26 provided in the upper part of the cyclone chamber 22. Thus, the predispersion having bubbles removed therefrom is taken out from an outlet 28 in the top. On the other hand, fine bubbles, which have a low density, gather in the center of the cyclone chamber and are discharged to the outside through a bubble discharge opening 30 from a bubble removing pipe 29 provided with a large number of holes, which is provided in the center of the cyclone chamber.

The use of a bubble removing apparatus having a cyclone chamber, as shown in this example, allows bubbles to be removed instantaneously and makes it possible to obtain a debubbled predispersion continuously.

Next, in the opposed impact type dispersing apparatus proposed by the present inventor (trade name: Ultimizer System, Japanese Patent Number 2,553,287; U.S. Pat. No. 5,380,089) or the like, a high pressure is applied to the predispersed fine particle suspension, and thereafter, the flow path is branched into two, and fine particle suspensions are made to collide with each other directly by nozzles opposed to each other. Thus, a highly dispersed fine particle dispersion can be obtained in large quantities without generating a contaminant.

Figure 4:
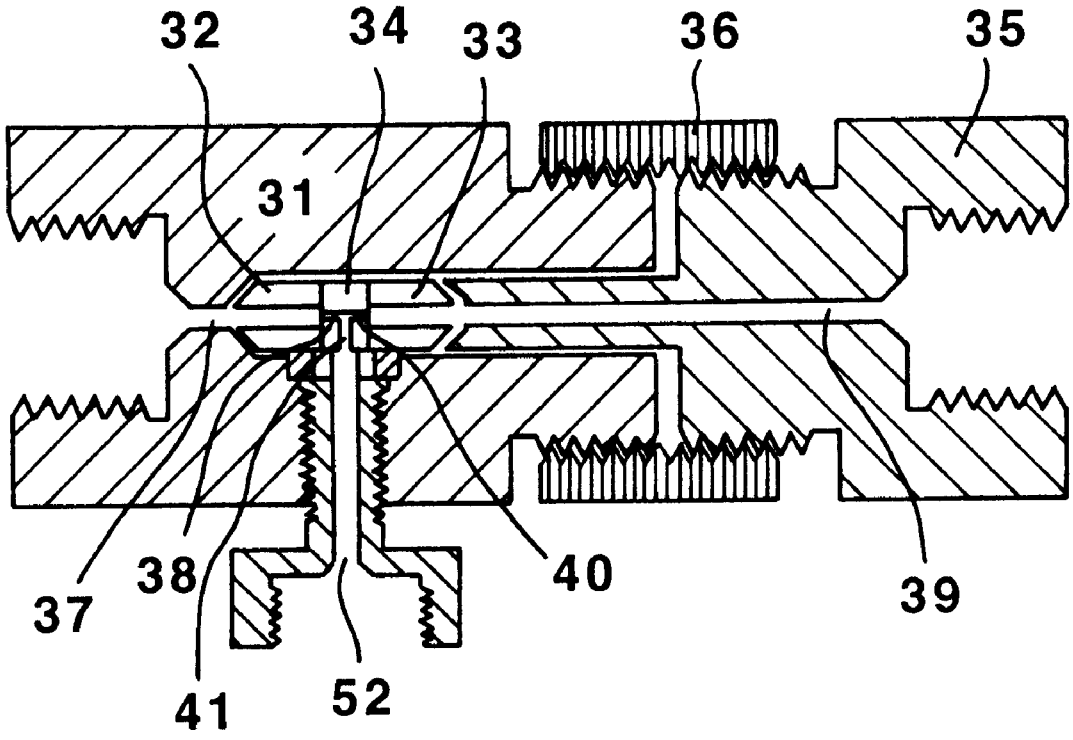
FIG. 4 is a diagram illustrating an opposed impact type dispersing apparatus used in the method of producing a fine particle dispersion according to the present invention.

FIG. 4 is a diagram illustrating an opposed impact type dispersing apparatus used in the fine particle dispersion producing method of the present invention.

A dispersing apparatus body 31 capable of enduring a high-pressure predispersion supplied to the dispersing apparatus has a space provided therein. A dispersing unit 34 is provided between metal seal members 32 and 33 in the space. A conversion coupling 35 is fastened by a coupler 36 provided with right- and left-hand threads.

A predispersion to be dispersed is pressurized by a high-pressure pump to enter one inlet passage 37 in the pressure vessel body and flow into an inlet port 38 in the dispersing unit. The inner diameter of the inlet port 38 is smaller than that of the inlet passage 37. Meanwhile, a predispersion is supplied under pressure from a conversion coupling-side inlet passage 39 so as to pass through the metal seal member and flow into the other inlet port 40 in the dispersing unit. The inner diameter of the inlet port 40 is smaller than that of the inlet passage 39. Thus, dispersion is carried out by collision between the predispersions supplied at high speed from the opposite directions to each other. After the dispersion has been carried out, the fine particle dispersion passes through an outlet port 41 and is taken out from an outlet passage 42.

The dispersing unit is kept in plane contact with the planar portions of the metal seal members to maintain a hermetic state in the high-pressure vessel by the fastening force of the conversion coupling. On the other hand, the outlet side of the emulsifying unit is provided with an O-ring 43 to prevent leakage.

In such an opposed impact type dispersing apparatus, if the dispersing unit is increased in size to allow an increased amount of predispersion to be treated and the left and right nozzles are made of a superhard substance, e.g. diamond, and opposed to each other, there may be cases where the center axes of the left and right nozzles cannot be made coincide with each other simply by fastening. If the center axes are not coincident with each other, the durability of the dispersing unit degrades. Moreover, fine particles arising from the wear of the dispersing unit may cause the quality of the product to be degraded as a contaminant.

In the impact dispersion type dispersing apparatus, however, because the pressure handled is high, each member is precisely machined, and the contact surfaces of the members are kept in plane contact with each other. In this state, the members are kept hermetic. Thus, the degree of coincidence between the center axes of the dispersing nozzles depends on the accuracy of each member and the assembly accuracy. Adjustment of the center axes or other similar means has not heretofore been used.

In the following apparatus, the center axis of one of the dispersing nozzles is finely adjustable, thereby allowing the center axes of the two dispersing nozzles to be made coincident with each other with high accuracy.

Figure 5:
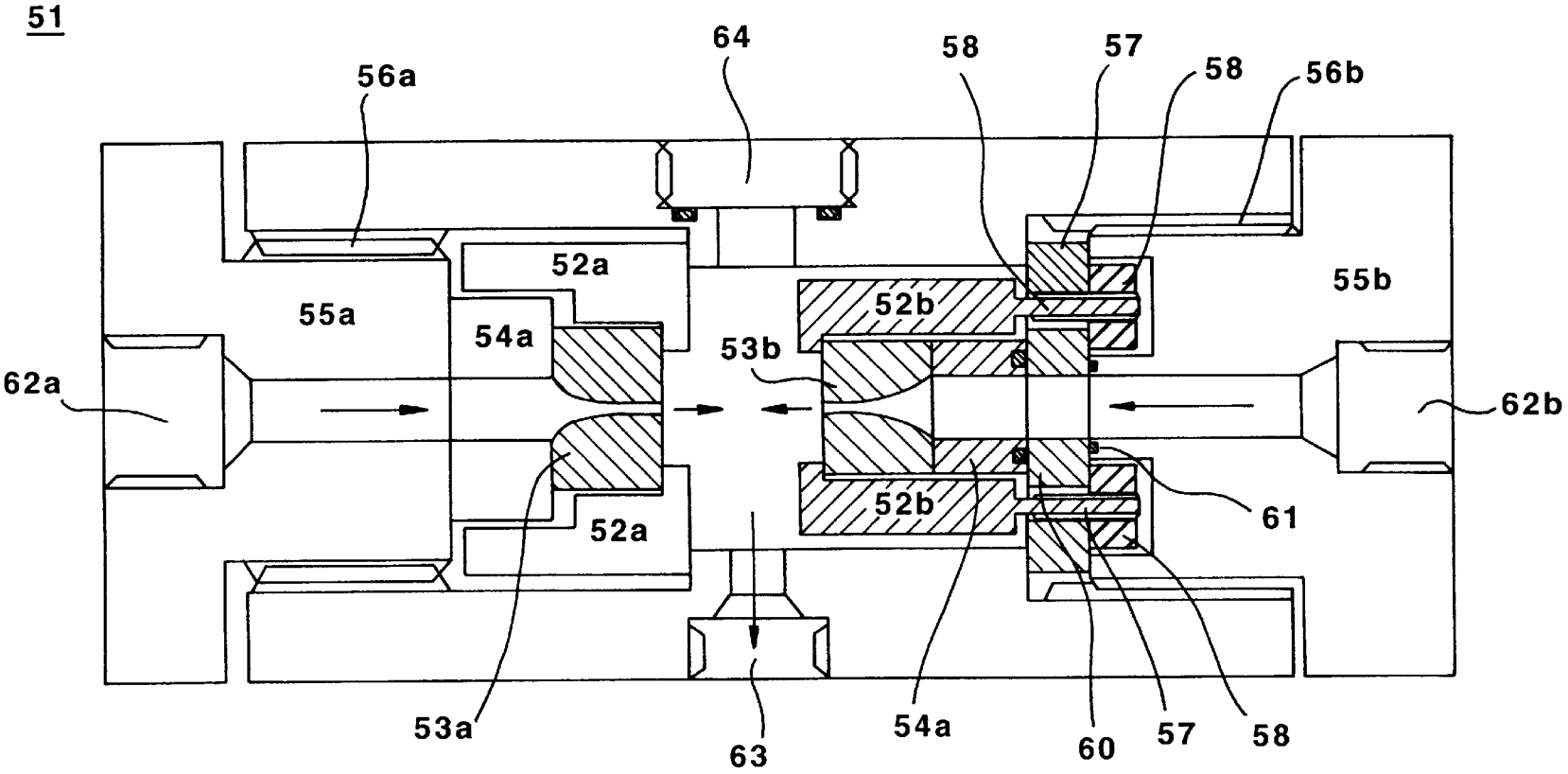
FIG. 5 is a diagram illustrating an opposed impact type dispersing apparatus used in the method of producing a fine particle dispersion according to the present invention.

FIG. 5 is a diagram illustrating an opposed impact type dispersing apparatus used in the method of producing a fine particle dispersion according to the present invention.

A dispersing apparatus body 51 withstanding high pressure has a dispersing nozzle retainer 52*a* provided in a space therein. The dispersing nozzle retainer 52*a* retains one dispersing nozzle 53*a* therein. A cylindrical dispersing nozzle fixing member 54*a* having therein a passage for a fluid to be dispersed, a dispersing nozzle fixing member 54*a* and a cylindrical fastening member 55*a* having therein a passage for a fluid to be dispersed are successively disposed on the fluid supply side of the dispersing nozzle 53*a*. These members are fastened to the dispersing apparatus body 51 by using a thread 56*a* provided on the outer surface of the fastening member 55*a*. Thus, the members are brought into plane contact with each other and fixed in a hermetic state.

The other dispersing nozzle 53*b* is opposed to the fixed dispersing nozzle 53*a* and retained in a dispersing nozzle retainer 52*b*. A cylindrical dispersing nozzle fixing member 54*b* having therein a passage for a fluid to be dispersed and a dispersing nozzle adjusting member 57 having therein a passage for a fluid to be dispersed are successively disposed on the fluid supply side of the dispersing nozzle 53*b*. The dispersing nozzle adjusting member 57 is arranged to secure the dispersing nozzle 53*a* and the dispersing nozzle fixing member 54*b* to the dispersing nozzle retainer 52*b* by tightening adjusting bolts 59 with respect to a plurality of adjusting thread portions 58 provided on the dispersing nozzle retainer 52*b* at respective positions equally spaced circumferentially.

When the dispersing nozzle adjusting member 57 is fixed by the plurality of adjusting thread portions 58 and the adjusting bolts 59, the position of the dispersing nozzle 53*a* and dispersing nozzle fixing member 54*b* can be slightly displaced by adjusting the tightening torque applied to each individual adjusting bolt 59. There may be cases where the contact surface of the fluid supply side of the dispersing nozzle fixing member 54*b* and the contact surface of the dispersing nozzle adjusting member 57 cannot be brought into complete plane contact with each other by adjusting the tightening torque of the adjusting bolts 59. However, an O-ring 60 or other hermeticity maintaining means is provided on the fluid supply side of the dispersing nozzle fixing member. Thus, the fluid supply surface side of the dispersing nozzle fixing member 54*b* and the dispersing nozzle adjusting member 57 are kept in a hermetic state.

Further, on the fluid supply side of the dispersing nozzle adjusting member 57, the dispersing nozzle adjusting member 57 and a cylindrical fastening member 55*b* having therein a passage for a fluid to be dispersed are successively disposed, and the dispersing nozzle adjusting member 57 is fastened by engagement between a thread 56*b* provided on the outer surface of the fastening member 55*b* and a thread provided on the dispersing apparatus body 51 and thus fixed at a predetermined position in the dispersing apparatus body 51. There may be cases where the contact surface of the fluid supply side of the dispersing nozzle adjusting member 57 and the contact surface of the fastening member 55*b* cannot be brought into complete plane contact with each other. However, an O-ring 61 or other hermeticity maintaining means is provided on the fastening member 55*b*. Therefore, hermeticity is maintained.

The fastening members 55*a* and 55*b* are provided with respective inlets 62*a* and 62*b* for a pressurized fluid. Fluids flowing in through the inlets 62*a* and 62*b* are jetted out from the dispersing nozzles 53*a* and 53*b* whose center axes are coincident with each other. Thus, the fluids collide with each other, thereby being dispersed to a high degree. Then, the dispersed fluid is taken out from an outlet 63.

The degree of coincidence between the center axes of the dispersing nozzles 53*a* and 53*b* can be confirmed by supplying water under a pressure of several MPa in a state where a plug 64 is removed from the dispersing apparatus body 51, and making a check as to whether or not the water jetted out from the dispersing nozzles 53*a* and 53*b* shows a disk-shaped locus that is right-angled over the whole circumference by head-on collision.

For example, assuming that the spacing between the dispersing nozzles 53*a* and 53*b* is 4 millimeters, if the sum total of the parallelism between the respective surfaces of the dispersing nozzles and an eccentricity due to the gaps between the dispersing nozzles 53*a* and 53*b* on the one hand and the dispersing nozzle retainers 52*a* and 52*b* on the other is 1°, 30', or 15', the tolerance is eliminated by adjusting by 3.49 micrometers, 1.74 micrometers, or 0.87 micrometers. Thus, the center axes of the two dispersing nozzles can be made coincident with each other.

A fine particle dispersing nozzle used in a dispersing apparatus is generally designed to maximize the flow rate and moreover arranged such that, as proposed in Japanese Patent Number 2,587,895 (U.S. Pat. No. 5,380,089) by the present inventor, the cross-sectional area of an orifice is gradually reduced in a curve from the inlet side of the nozzle to the minimum orifice diameter portion so that an area where only a liquid is present is formed around a solid-liquid multiphase flow that has passed the minimum orifice diameter portion. The use of such a nozzle makes it possible to prevent collision of solid particles against the wall surface and to obtain a nozzle of high durability.

Figure 6:
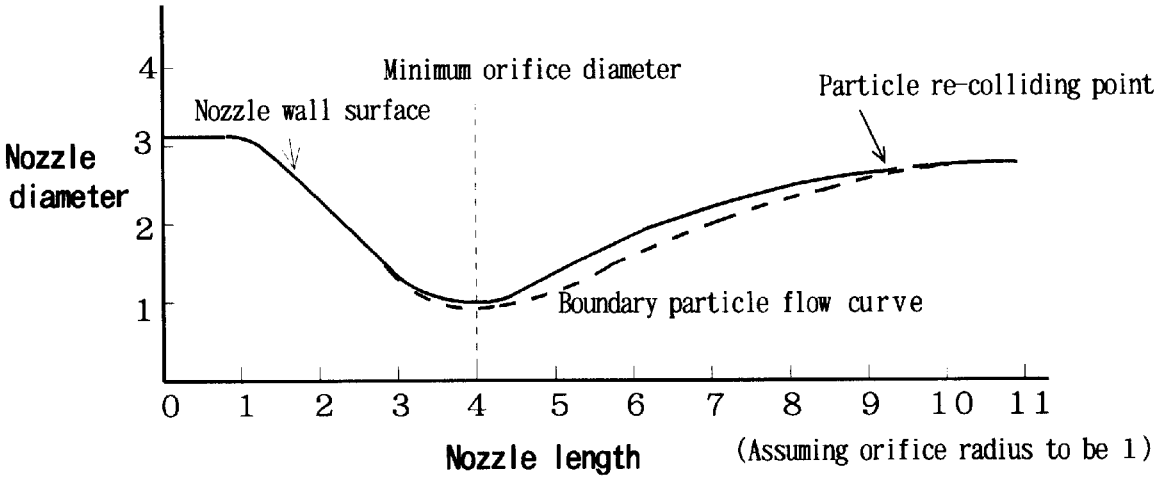
FIG. 6 is a diagram illustrating the sectional configuration of a nozzle and the condition of presence of solid particles in a solid-liquid multiphase fluid.

FIG. 6 is a diagram illustrating the sectional configuration of a nozzle and the condition of presence of solid particles in a solid-liquid multiphase fluid. In a case where an orifice is formed between the inlet side and the outlet side, the cross-sectional area of the duct is gradually reduced toward the orifice. More specifically, in the example shown in FIG. 5, the inlet side is formed from a duct of 1 millimeter in size, and the cross-sectional area of the duct is gradually reduced to an orifice diameter of 0.3 millimeters over a length of 0.52 millimeters.

Consequently, a boundary particle streamline that defines an area where no particles are present is formed by the orifice. The axis of abscissa represents the length of the nozzle on the assumption that the orifice radius is 1, and the axis of ordinate represents the diameter of the duct on the assumption that the orifice radius is 1. Because a part where no particles are present is formed on the outlet side of the orifice in the nozzle, the nozzle can be prevented from wearing by forming the wall surface more away from the center axis than the boundary particle streamline.

Meanwhile, the present inventor found that the use of an orifice whose cross-sectional area gradually increases as a dispersing nozzle allows extremely fine particles to be obtained, although the flow rate is reduced. Accordingly, the purpose of obtaining fine particles with an extremely small particle size can be attained by using a dispersing nozzle whose cross-sectional area gradually increases.

Figure 7:
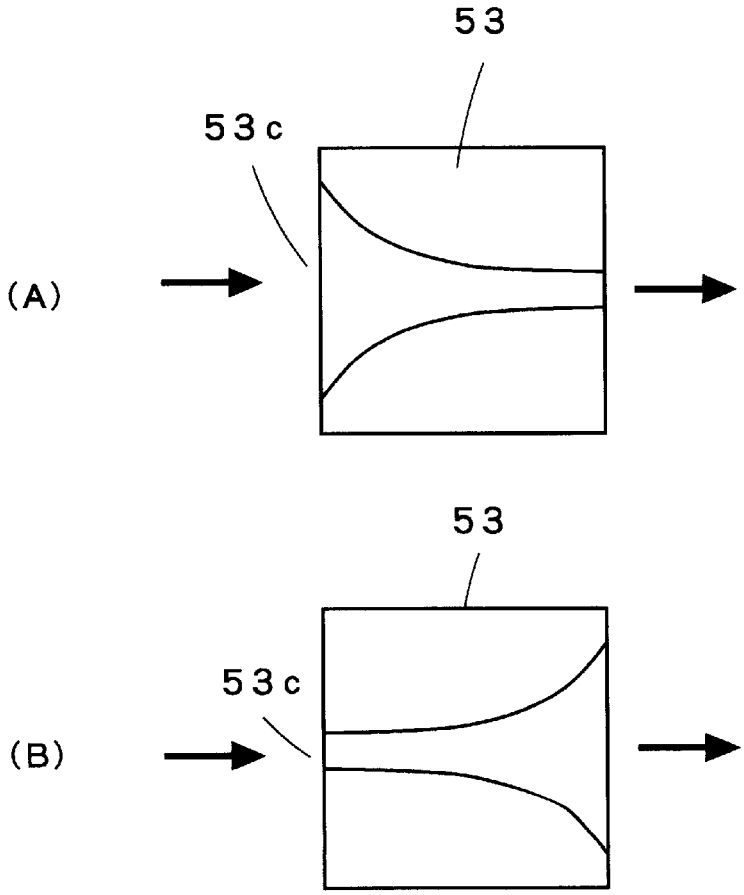
FIG. 7 is a diagram illustrating an example of dispersing nozzles.

FIG. 7 illustrates an example of dispersing nozzles.

FIG. 7(A) is a diagram illustrating a nozzle exhibiting a high flow rate. A fluid entering a dispersing nozzle 53 from an inlet side 53*c* suffers a loss owing to the gradual reduction in the cross-sectional area. However, because the flow velocity is sufficiently high, the loss of head can be ignored. Thus, the maximum flow rate can be obtained.

On the other hand, in the case of using a dispersing nozzle in which, as shown in FIG. 7(B), the area of the inlet side 53*c* is reduced, and which has such an orifice diameter that the area gradually increases in reverse relation to FIG. 7(A), it is possible to obtain fine particles having a smaller size than in the case of FIG. 7(A), although the flow rate becomes lower than in the case of the nozzle shown in FIG. 7(A).

EXAMPLES

Examples of the present invention will be shown below to describe the present invention.

(Preparation of a predispersion)

Into 70 kg of pure water, fumed silica having a specific surface area of 50 to 380 g/cm$^2$ and a primary particle size of 7 to 30 nanometers was sucked in varying amounts and stirred with a suction stirring apparatus having a rotor diameter of 160 millimeters, a stator inner diameter of 170 millimeters, a rotating shaft diameter of 260 millimeters, an air flow duct inner diameter of 300 millimeters, an air flow duct outer diameter of 310 millimeters, a fine particle passage inner diameter of 350 millimeters and a fine particle suction pipe inner diameter of 30 millimeters. Thereafter, bubbles were removed by a cyclone type bubble removing apparatus.

Figure 8:
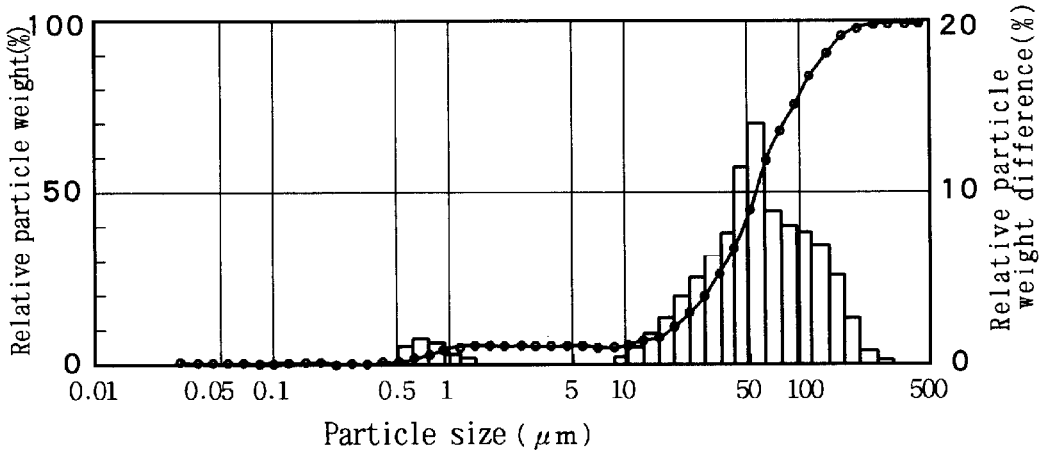
FIG. 8 is a diagram illustrating the particle size distribution of a predispersion obtained.

The viscosity of the predispersion obtained was 120 cP. The particle size distribution of a predispersion having a concentration of 30% by weight was measured with a laser beam diffraction type particle size distribution measuring apparatus (SALD-2000A, manufactured by Shimadzu Corporation). The result of the measurement is shown in FIG. 8.

Example 1

To ultrapure water, potassium hydroxide was added as a pH adjustor to prepare an alkaline solution having a pH of 11. Into the alkaline solution, fumed silica was introduced in three different amounts, i.e. 12.5% by weight, 25% by weight, and 60% by weight, with a suction stirring machine to prepare three different predispersions.

Next, the predispersions were each treated in two different numbers of passes, i.e. 1 pass and 3 passes, under 200 MPa with a dispersing apparatus (Ultimizer System HJP-25028, manufactured by Sugino Machine) having the dispersing nozzle shown in FIG. 4, thereby preparing 6 dispersions in total. The particle size of fine particles in each dispersion and the particle size distribution thereof were measured with a laser beam diffraction type particle size distribution measuring apparatus (SALD-2000A, manufactured by Shimadzu Corporation). The result of the measurement is shown in FIG. 8. The treating conditions of each sample and the characteristics of the particles obtained are shown in Table 1 below.

TABLE 1

| Oxide concentration (wt %) | Treating pressure (MPa) | Number of passes | Breadth of particle size distribution (nm) | Center particle size (nm) | Foreign matter (ppb) |
|---|---|---|---|---|---|
| 12.5 | 200 | 1 | 180–530 | 178 | not detected |
| 12.5 | 200 | 3 | 80–340 | 156 | not detected |
| 25 | 200 | 1 | 80–530 | 178 | not detected |
| 25 | 200 | 3 | 80–340 | 156 | not detected |
| 60 | 200 | 1 | 100–500 | 198 | not detected |
| 60 | 200 | 3 | 80–410 | 180 | not detected |

Figure 9:
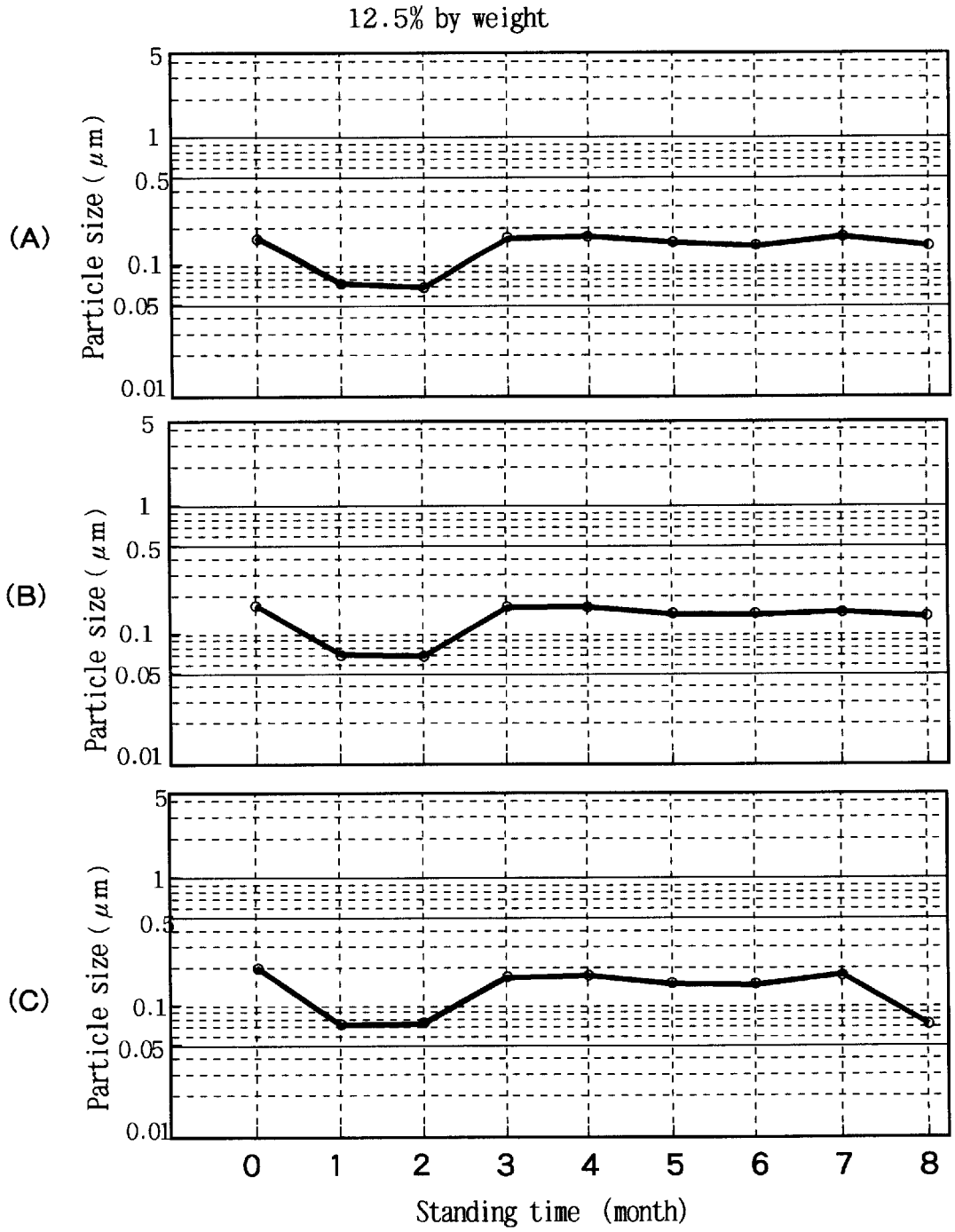
FIG. 9 is a diagram illustrating the change with time of the particle size distribution of a dispersion obtained.
Figure 10:
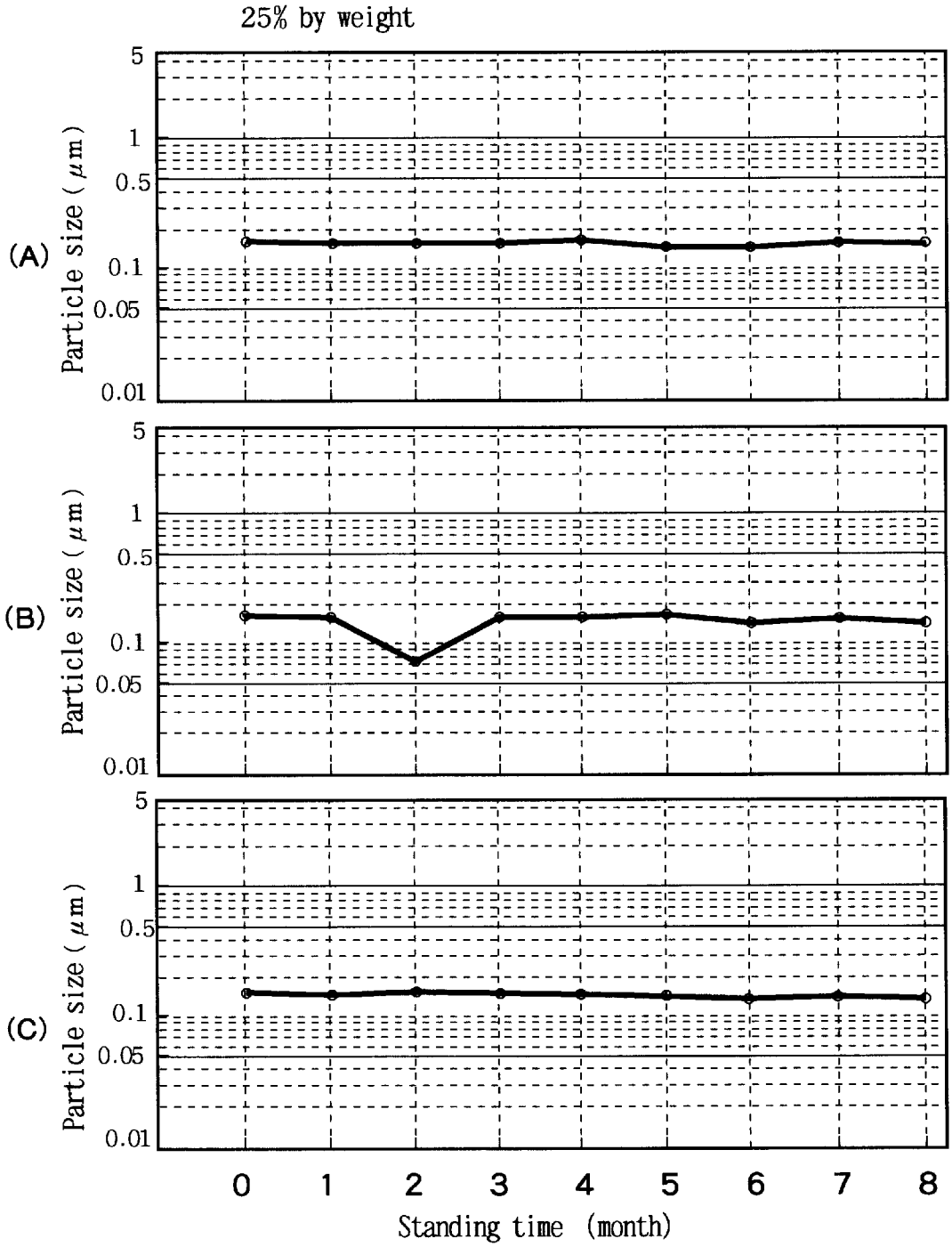
FIG. 10 is a diagram illustrating the change with time of the particle size distribution of a dispersion obtained.
Figure 11:
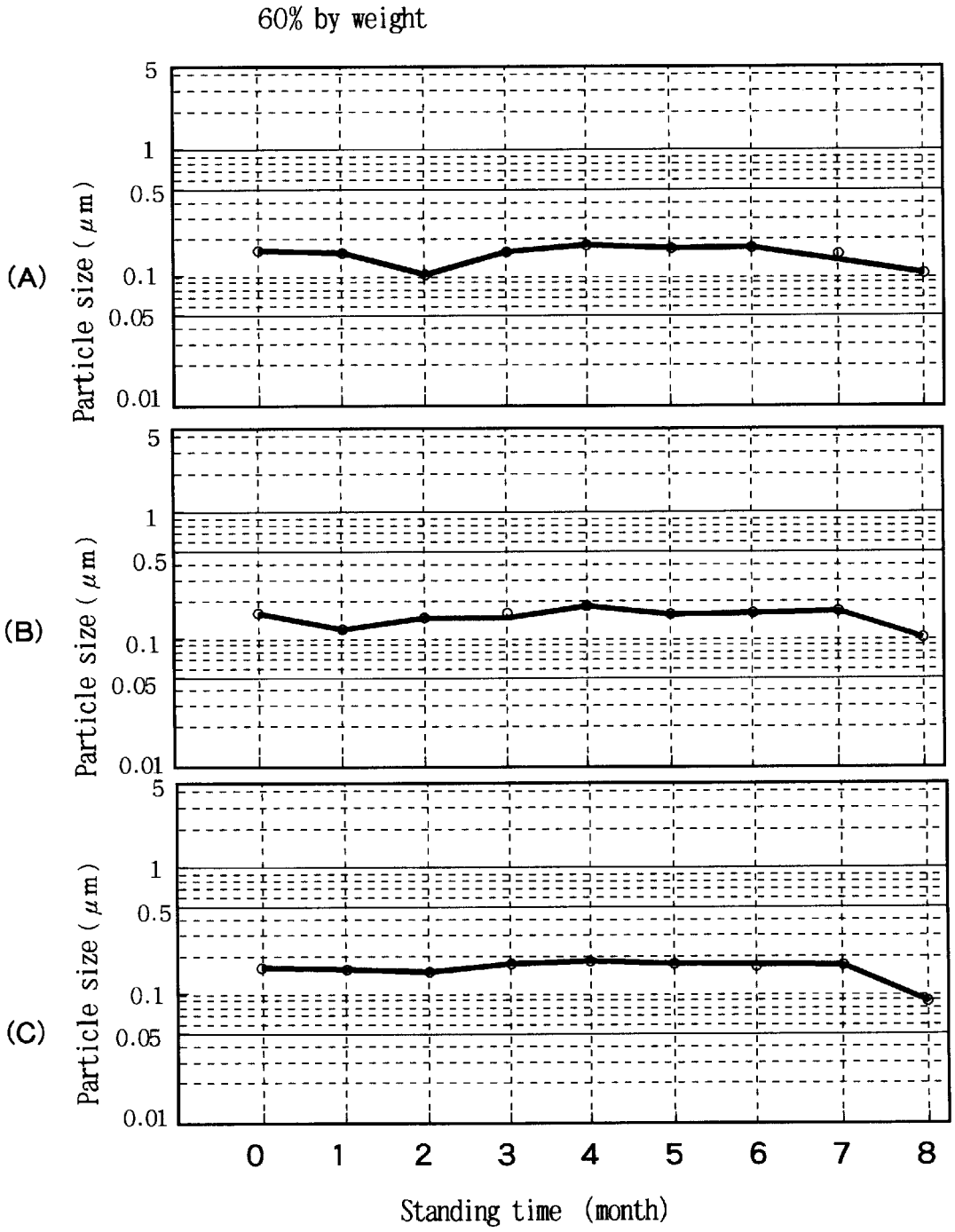
FIG. 11 is a diagram illustrating the change with time of the particle size distribution of a dispersion obtained.
Figure 12:
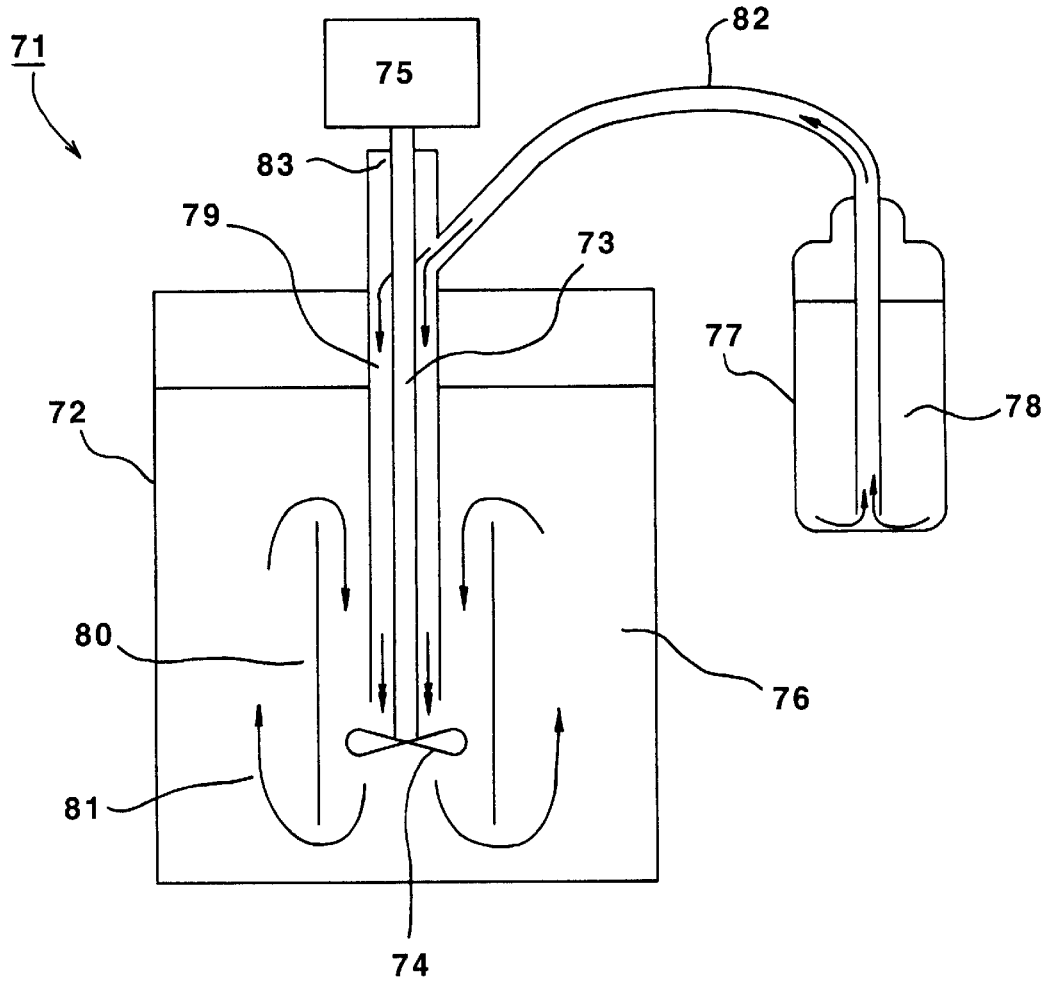
Fig. 12 PRIOR ART
FIG. 12 is a diagram illustrating a conventional suction stirring apparatus.

Next, a container containing each dispersion obtained was stored at 25° C., and 0.2 milliliters of the dispersion was sampled from each of three different layers of the dispersion in the container, i.e. the top (a layer 10 millimeter from the liquid surface), the middle (a layer 100 millimeters from the liquid surface), and the bottom (a layer 190 millimeters from the liquid surface), every month to measure the particle size distribution of fine particles with a laser beam diffraction type particle size distribution measuring apparatus (SALD-2000A, manufactured by Shimadzu Corporation). The results of the measurement are shown in FIG. 9 (raw material: 12.5% by weight), FIG. 10 (raw material: 25% by weight) and FIG. 11 (raw material: 60% by weight). In each of these figures: (A) shows the particle size distribution in the top; (B) shows the particle size distribution in the middle; and (C) shows the particle size distribution in the bottom. The axis of abscissa represents the number of months of storage.

Example 2

Into ultrapure water, aluminum oxide having a center particle size of 13 nanometers and a specific surface area of 100 $m^2/g$ was introduced in three different amounts, i.e. 12.5% by weight, 25% by weight, and 60% by weight, with a suction stirring machine to prepare three different predispersions.

Next, the predispersions were each treated in 3 passes under 200 MPa with a dispersing apparatus (Ultimizer System HJP-25028, manufactured by Sugino Machine) having the dispersing nozzle shown in FIG. 4 to prepare dispersions, and the particle size of fine particles in each dispersion and the particle size distribution thereof were measured with a laser beam diffraction type particle size distribution measuring apparatus (SALD-2000A, manufactured by Shimadzu Corporation). The treating conditions of each sample and the characteristics of the particles obtained are shown in Table 2 below.

TABLE 2

| Oxide concentration (wt %) | Treating pressure (MPa) | Number of passes | Breadth of particle size distribution (nm) | Center particle size (nm) | Foreign matter (ppb) |
|---|---|---|---|---|---|
| 12.5 | 200 | 3 | 65–300 | 158 | not detected |
| 25 | 200 | 3 | 68–330 | 162 | not detected |
| 60 | 200 | 3 | 72–360 | 170 | not detected |

Example 3

Into ultrapure water, aluminum oxide having a center particle size of 21 nanometers and a specific surface area of 50 $m^2/g$ was introduced in two different amounts, i.e. 30% by weight, and 60% by weight, with a suction stirring machine to prepare two different predispersions.

Next, the predispersions were each treated in 3 passes under 200 MPa with a dispersing apparatus (Ultimizer System HJP-25028, manufactured by Sugino Machine) having the dispersing nozzle shown in FIG. 4, to prepare dispersions, and the particle size of fine particles in each dispersion and the particle size distribution thereof were measured with a laser beam diffraction type particle size distribution measuring apparatus (SALD-2000A, manufactured by Shimadzu Corporation). The treating conditions of each sample and the characteristics of the particles obtained are shown in Table 3 below.

TABLE 3

| Oxide concentration (wt %) | Treating pressure (MPa) | Number of passes | Breadth of particle size distribution (nm) | Center particle size (nm) | Foreign matter (ppb) |
|---|---|---|---|---|---|
| 35 | 220 | 3 | 156–556 | 440 | not detected |
| 60 | 220 | 3 | 160–576 | 457 | not detected |

Example 4

Next, the predispersions were each treated in 3 passes under 200 MPa with a dispersing apparatus (Ultimizer System HJP-25028, manufactured by Sugino Machine) having the same dispersing nozzle as shown in FIG. 4 except that the suction opening and the discharge opening of the dispersing nozzle were installed in reverse relation to that in FIG. 4 and that the diameter of the suction opening was 0.2 millimeters and the diameter of the discharge opening was 0.2 millimeters, to prepare 3 dispersions in total, and the particle size of fine particles in each dispersion and the particle size distribution thereof were measured with a laser beam diffraction type particle size distribution measuring apparatus (SALD-2000A, manufactured by Shimadzu Corporation). The treating conditions of each sample and the characteristics of the particles obtained are shown in Table 4 below.

TABLE 4

| Oxide concentration (wt %) | Treating pressure (MPa) | Number of passes | Breadth of particle size distribution (nm) | Center particle size (nm) | Foreign matter (ppb) |
|---|---|---|---|---|---|
| 12.5 | 200 | 3 | 30–210 | 80 | not detected |
| 25 | 200 | 3 | 30–210 | 78 | not detected |
| 60 | 200 | 3 | 30–230 | 79 | not detected |

Industrial Applicability

A fine particle dispersion produced by the method of the present invention has a uniform particle size and a narrow particle size distribution breadth. Thus, a high-purity and uniform fine particle dispersion can be obtained. Accordingly, the present invention exhibits significant effects in various use applications, including the process of smoothing and planarizing oxide films, e.g. interlayer insulator films, and metal wiring films in the semiconductor manufacturing process.

What is claimed is:

1. A method of producing a fine particle dispersion characterized by having a dispersing step where, after fine particles have been sucked into a dispersing medium to prepare a suspension by a suction stirring machine and bubbles have been removed from the suspension by a bubble removing means, the suspension is pressurized and introduced from opposite directions so as to collide with each other, thereby dispersing the suspension.

2. A method of producing a fine particle dispersion according to claim 1, wherein in the suction stirring machine, only a flow path for an air flow is formed in a space where a rotating shaft is exposed, and a flow path for fine particles is formed outside the flow path for an air flow.

3. A method of producing a fine particle dispersion according to either of claims 1 or 2, wherein the bubble removing means is a cyclone bubble removing means.

4. A method of producing a fine particle dispersion according to any one of claims 1 and 2, wherein a dispersing means capable of adjusting a center axis of a dispersing nozzle is used as one of two dispersing nozzles in the dispersing step.

5. A method of producing a fine particle dispersion according to any one of claims 1 and 2, wherein a dispersing means having a dispersing nozzle in which a cross-sectional area gradually increases from an inlet side thereof toward an outlet side thereof is used in the dispersing step.

* * * * *